US007845266B2

(12) United States Patent
Duke et al.

(10) Patent No.: US 7,845,266 B2
(45) Date of Patent: Dec. 7, 2010

(54) MODULAR POLYMERIC PROJECTILE ABSORBING ARMOR

(75) Inventors: Leslie P. Duke, Silver Creek, GA (US); Wayne Barrett, Dahlonega, GA (US)

(73) Assignee: Ballistics Blocks LLC, Alpharetta, GA (US)

( * ) Notice: Subject to any disclaimer, the term of this patent is extended or adjusted under 35 U.S.C. 154(b) by 818 days.

(21) Appl. No.: 11/620,810

(22) Filed: Jan. 8, 2007

(65) Prior Publication Data

US 2010/0282060 A1 Nov. 11, 2010

Related U.S. Application Data

(63) Continuation-in-part of application No. 11/180,843, filed on Jul. 13, 2005.

(60) Provisional application No. 60/777,324, filed on Feb. 28, 2006, provisional application No. 60/587,940, filed on Jul. 14, 2004, provisional application No. 60/590,215, filed on Jul. 22, 2004.

(51) Int. Cl.
*F41H 5/24* (2006.01)

(52) U.S. Cl. ..... 89/36.04; 89/36.01; 89/36.02

(58) Field of Classification Search ..... 89/36.01, 89/36.02, 36.04; 428/911
See application file for complete search history.

(56) References Cited

U.S. PATENT DOCUMENTS 964,160 A * 7/1910 Hammett ..... 52/590.1
3,305,982 A * 2/1967 Steele ..... 52/90.1
3,645,961 A * 2/1972 Goldfein ..... 524/5
4,041,670 A * 8/1977 Kaplan ..... 52/592.2
4,179,979 A * 12/1979 Cook et al. ..... 89/36.02
4,388,874 A * 6/1983 Stone ..... 109/79
4,550,543 A * 11/1985 Valenzano ..... 52/309.7
4,567,100 A 1/1986 Pickett et al.
4,671,039 A * 6/1987 Hunt ..... 52/591.2
4,683,800 A * 8/1987 Snedeker ..... 89/36.02
4,760,611 A * 8/1988 Huet et al. ..... 2/2.5
4,763,457 A * 8/1988 Caspe ..... 52/504
4,896,472 A * 1/1990 Hunt ..... 52/592.6
5,035,532 A * 7/1991 Gargollo ..... 404/41

(Continued)

FOREIGN PATENT DOCUMENTS

CH 215 690 A 7/1941

(Continued)

OTHER PUBLICATIONS

Imternational Search Report and Written Opinion—PCT/US2008/000273.

*Primary Examiner*—Michelle Clement
(74) *Attorney, Agent, or Firm*—Womble Carlyle Sandridge & Rice PLLC

(57) ABSTRACT

A building block for constructing a projectile absorbing armor. The building block has at least one interlocking male connector and at least one female connector. The interlocking male connector and said female connector are sized for interlocking engagement. The invention is also generally directed to a structure having projectile absorbing armor having at least two building blocks in interlocking engagement. The building blocks are constructed from projectile resistant material and may have various features to prevent the passage of a projectile through the block.

13 Claims, 12 Drawing Sheets

U.S. PATENT DOCUMENTS

| | | | | | |
|---|---|---|---|---|---|
| 5,337,527 | A | * | 8/1994 | Wagenaar | 52/169.2 |
| 5,365,714 | A | * | 11/1994 | Potvin | 52/590.2 |
| 5,653,621 | A | * | 8/1997 | Yao | 446/127 |
| 5,839,243 | A | * | 11/1998 | Martin | 52/439 |
| 6,079,902 | A | * | 6/2000 | Pettee, Jr. | 405/35 |
| 6,250,986 | B1 | * | 6/2001 | Sorensen | 446/85 |
| 6,616,499 | B1 | * | 9/2003 | Sorensen | 446/85 |
| 6,695,534 | B2 | * | 2/2004 | Cain et al. | 405/52 |
| 2006/0013977 | A1 | | 1/2006 | Duke et al. | |

FOREIGN PATENT DOCUMENTS

| | | | |
|---|---|---|---|
| DE | 31 22 367 | C1 | 12/1994 |
| GB | 210 519 | A | 1/1924 |
| GB | 760 804 | A | 11/1956 |
| WO | WO 97/38848 | A | 10/1997 |
| WO | WO 2003/101726 | A | 12/2003 |
| WO | WO 2005/038388 | A | 4/2005 |

* cited by examiner

MODULAR POLYMERIC PROJECTILE ABSORBING ARMOR

CROSS-REFERENCE TO RELATED APPLICATIONS

The benefit is hereby claimed of the filing date of U.S. Provisional Application No. 60/777,324, filed on Feb. 28, 2006, the entire contents of which are hereby incorporated by reference as if presented herein in their entirety. Also, this application is a continuation-in-part of, and claims priority to, U.S. patent application Ser. No. 11/180,843, filed Jul. 13, 2005, which claims priority to U.S. Provisional Application No. 60/590,215, filed Jul. 22, 2004 and U.S. Provisional No. 60/587,940, filed Jul. 14, 2004, all of which are hereby incorporated by reference as if presented herein in their entirety.

BACKGROUND OF THE INVENTION

The present invention generally relates to a polymeric block having excellent properties for absorbing incoming high speed projectiles such as bullets and the like. More particularly, the present invention relates to relatively lightweight polymeric blocks that are readily assembled into a projectile absorbing armor. The material of the blocks is preferably a polymeric foam material and can include one or more layers of such material.

In additional embodiments, objects made of a hardened material, such as steel and the like, may be interspersed throughout the interior volume of the blocks. Such hardened objects increase the ability of the armor assembled from the blocks to absorb incoming projectiles in at least two ways. First, the directional path of an incoming projectile that encounters one of the hardened objects is deflected in such a manner as to increase the rate at which the projectile decelerates as it penetrates into the armor. Second, incoming projectiles may become deformed, disintegrate, or shatter upon encountering one or more of the hardened objects and such deformation, disintegration, or shattering will also tend to impede penetration into the armor.

SUMMARY OF THE INVENTION

In one embodiment, the invention is generally directed to a building block for constructing a projectile absorbing armor. The building block comprises a top surface, a bottom surface, a first side surface, a second side surface, a first end surface and a second end surface. The top, bottom, side, and end surfaces cooperate to form an interior. The building block comprises a projection on the top surface and a recess in the bottom surface. The projection and the recess are sized for interlocking engagement. At least one interlocking male connector is on at least one of the first side surface, the second side surface, the first end surface, and the second end surface. At least one female connector is on at least one of the first side surface, the second side surface, the first end surface, and the second end surface. The interlocking male connector and the female connector are sized for interlocking engagement.

In another embodiment, the invention is generally directed to a structure having a projectile absorbing armor. The structure comprises at least two building blocks in interlocking engagement. The at least two building blocks are constructed of projectile resistant material. The at least two building blocks comprise a first building block and a second building block. The first building block has at least one interlocking male connector and the second building block has at least one female connector. The interlocking male connector of the first building block is received in the female connector of the second building block to secure the first and second building blocks in the interlocking engagement.

In yet another embodiment, the invention is generally directed to a projectile absorbing structure. The structure comprises a body formed at least partially of a polymeric material selected to retard motion of a projectile moving therethrough. A plurality of hardened objects are within the body. The plurality of hardened objects are arranged into a predetermined matrix selected to ensure that a projectile moving through the body encounters at least one of the hardened objects.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated, where appropriate, by corresponding reference numbers throughout the drawings.

DETAILED DESCRIPTION OF THE EXEMPLARY EMBODIMENTS

Figure 1:
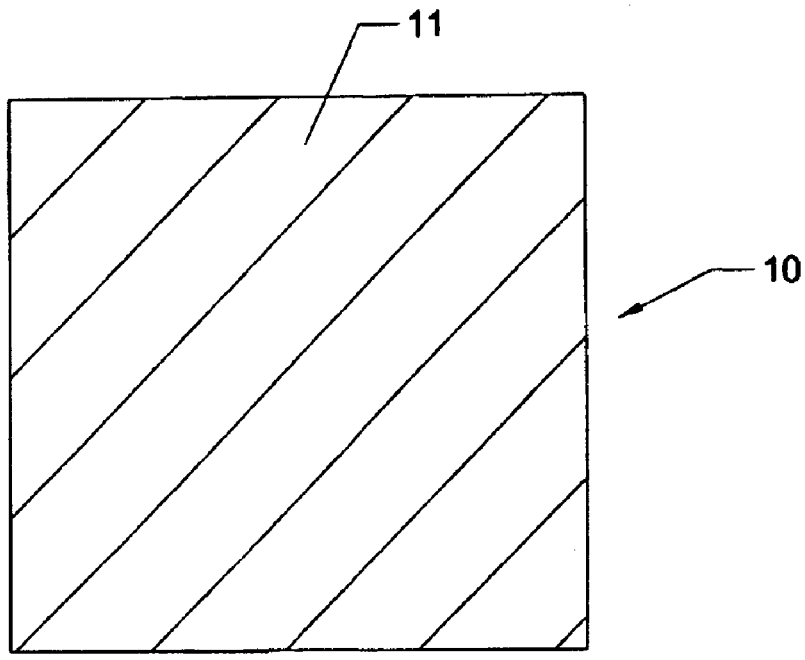
FIG. 1 is a cross section of one embodiment of the interior structure of the present invention.
Figure 2:
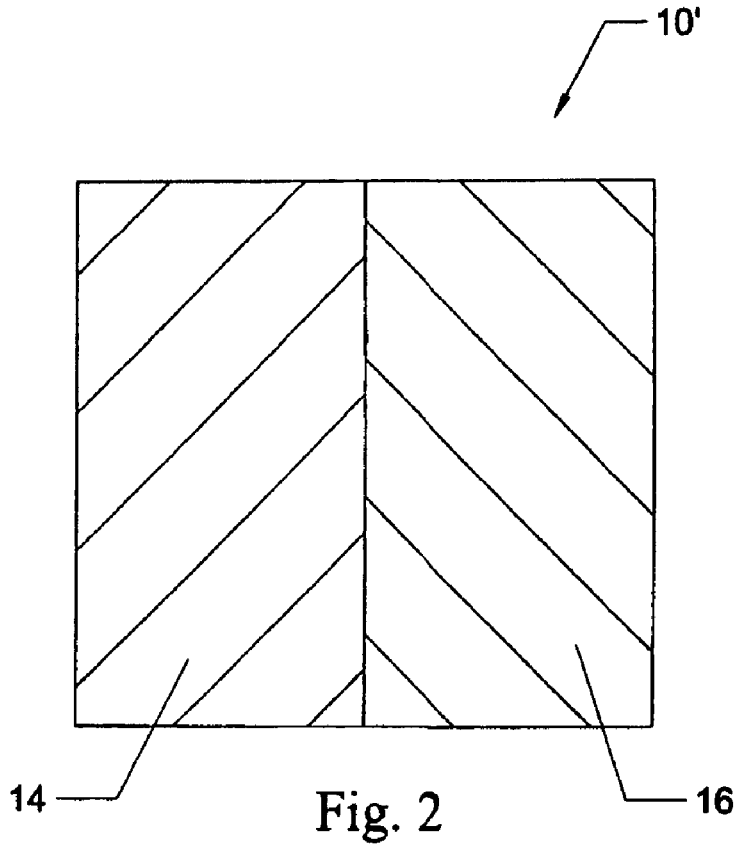
FIG. 2 is a cross section of a different embodiment of the structure of the present invention.

FIG. 1 shows a polymeric block 10 of the present invention in a cross sectional simplified form. In one embodiment, the block 10 is made from at least one layer of a polymeric material 11. Suitable materials for the polymeric material 11 include a thermoplastic material (e.g., linear low density polyethylene (LLDPE) such al LL 6100 or 6200 or other suitable thermoplastics), a thermoset polymer (e.g., elastomeric polyurethanes, EPDM, or other suitable thermoset polymers), various amounts of other materials and additives, (e.g., natural or synthetic rubber, ceramic fibers or fillers, etc.), or any other suitable material for retarding the motion of a projectile therethrough. A high velocity projectile encountering the surface plane of a polymeric block 10 made from the polymeric material 11 at a perpendicular angle or relatively low angle of incidence, will penetrate the outer surface of the block 10 and decelerate rapidly to a complete stop, often within a matter of inches. The block thus absorbs and captures incoming projectiles. The block 10 can be customized to various thicknesses to protect against anticipated high velocity projectiles. Twelve inches of the polymeric material 11 has been shown to stop the following munitions:

.50 caliber—BMG ball, AP, APIT, incendiary, and Roufuss
.30-06 caliber—ball and tracer
7.62×39 mm (AK-47 standard)—ball, AP, tracer
.223 caliber—ball, AP
5.45×39 mm (AK-74 standard)—ball As the angle of incidence to the surface plane of the block 10 increases, the ability of the polymeric material 11 to capture and absorb projectiles varies in accordance with the velocity of the projectile and the density of the polymer 11. Relatively low velocity projectiles encountering the surface plane of the armor of the block 10 at a relatively high level of incidence tend to bounce or ricochet off the material if the surface density is too high, for example, around 0.95 to 1.5 g/cc or higher. Thus, it is advantageous in some cases to fabricate the block 10 in multiple layers with an outward facing layer of somewhat lower density material, for example, around 0.2-0.95 g/cc at the surface of the block, and a second, interior layer of higher density material, around 0.95-1.5 g/cc or higher below the first layer. The lower density material may be the same polymer material as the higher density material, but more highly foamed. Alternatively, two different polymeric formations may be joined together, with a lower density polymer disposed toward the direction of incoming projectiles. FIG. 2 illustrates a modified block 10' that is made of two layers as just described, a first outward facing layer 14 and a second interior layer 16. The first layer 14 is assumed to be facing the direction from which projectiles would be coming, and is thus of the lower density polymeric material. The second layer 16 then is of the higher density polymeric material as just descried.

Once the basic internal structure of the block 10 has been determined, based on the anticipated projectiles to be encountered, the block 10 can be fabricated into a number of shapes so that the shapes may function as convenient building blocks for assembling a plurality of individual, modular units into armor for a larger structure, or to provide an armor structure, itself. A structure built of the blocks 10 will provide significant blast or shock wave protection, as well as protection against projectiles. Fabricating the blocks 10 into modular building blocks has the advantage of concentrating the armor material in a relatively small volume for transportation to a field site where the blocks 10 can be assembled and used. The configuration of the blocks 10 allow them to be assembled into a wide variety of shapes, either to augment the protection offered by the exterior walls of existing structures or vehicles, or alternatively, to assemble the blocks 10 into stand alone structures such as walls or enclosed bunkers.

Figure 3:
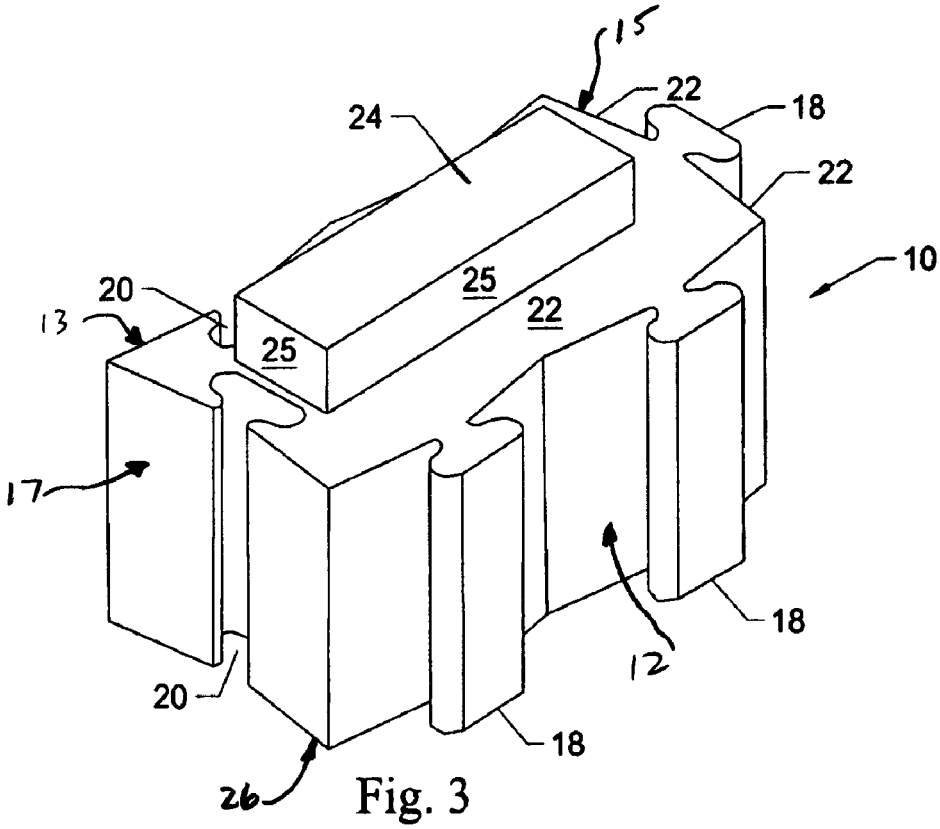
FIG. 3 is a view of a building block made in accordance with the present invention.

FIG. 3 illustrates a preferred configuration for the block 10. The external shape of the block 10 is designed to allow a wide range of larger shapes or structures of armor to be constructed from a single plurality of block units, all of which block units may be the same size and shape. Alternatively, the plurality of block units may comprise blocks having different shapes and locking arrangements. The commonly used children's Lego® blocks are one example of interlocking block-like structures that are familiar and that may be used in this invention. However, Lego® blocks cannot be locked together like the blocks 10 of the present invention, which do not require separate corner or end pieces. One advantage of using a plurality of block units, all of a single, uniform shape, is that it minimizes the amount of planning and administration associated with maintaining inventory and assembling quantities of material and construction kits for transportation to and construction at remote locations. In other words, each and every block 10 in a structure is interchangeable with every other block 10 in a structure. Any given block 10 can be interlocked, and interconnected into a monolithic structure, regardless of whether the block 10 is situated on the top or bottom of the structure or is located at the corner or along the wall of the structure. That is, one can consider the block 10 to be capable of interlocking on all six sides (e.g., a first side surface 12, a second side surface 13, a first end surface 15, a second end surface 17, a top surface 22, and a bottom surface 26). In the illustrated embodiment, the side surfaces 12, 13 are generally opposed surfaces of the block 10, the end surfaces 17, 22 are generally opposed surfaces of the block, and the top and bottom surfaces 22, 26 are generally opposed surfaces of the block. The block 10 may be otherwise oriented such that the surfaces identified as "side", "end", "top", and "bottom" may be positioned without departing from the scope of this invention.

In FIG. 3, the block 10 is seen from a top front angle. The block includes interlocking male portions 18 (broadly "male connector"). The interlocking male portions 18 are sized to be received in corresponding slot portions 20 (broadly "female connector"). In the illustrated embodiment, the block 10 includes two interlocking male portions 18 on the first side surface 12 and one interlocking male portion on the first end surface 15. The second side surface 13 has two slot portions 20 and the second end surface has one female slot portion. It is understood that each surface of the block may be include other quantities of male and female connectors without department from the invention.

Figure 4:
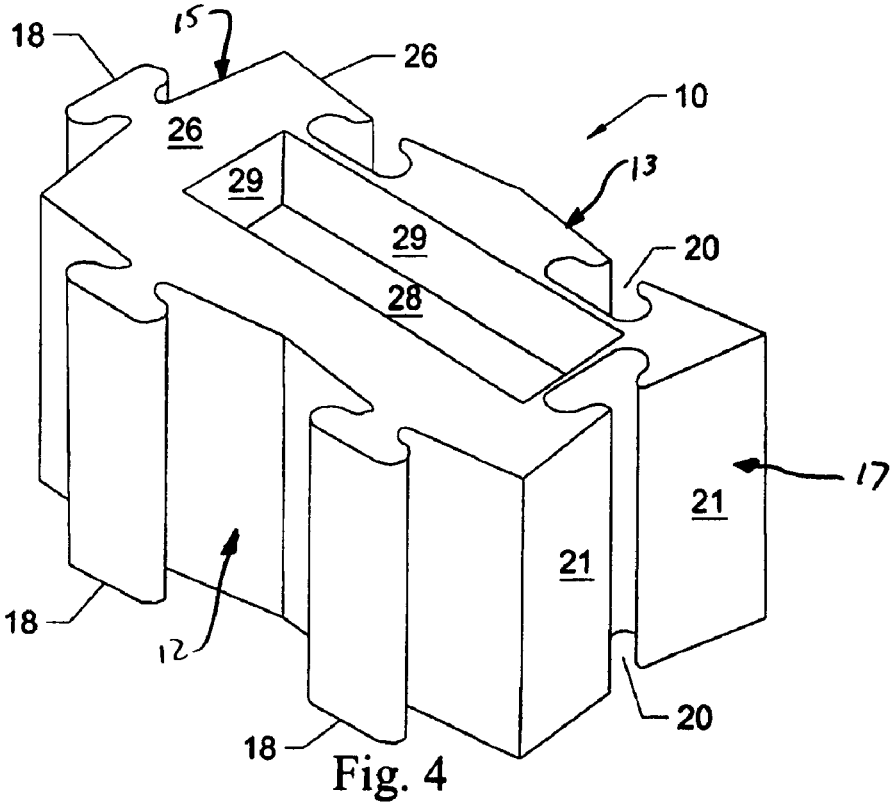
FIG. 4 is a view of the block of FIG. 3 from the bottom.

The block 10 includes a top surface 22, which has extending from it a generally rectangular projection 24 that is used to fit into a corresponding rectangular slot 28 (see FIG. 4) to allow stacking of the blocks 10. In FIG. 4, the block 10 is viewed from the bottom. The block 10 includes a bottom surface 26 into which is formed a slot 28 that cooperates with the rectangular projection 24 to allow stacking of the blocks 10. The rectangular projection 24 and the slot or recess 28 are sized to cooperate with one another. In this view of the block 10, the interlocking portions 18 and corresponding slots 20 are viewed from the bottom side of the block 10.

The blocks 10 can be fabricated in a height, width, and depth so that the weight of the block 10 can be readily lifted and transported short distances by hand for manual assembly of the blocks into a larger structure or armor. This is a function of the polymeric material used in the blocks and the size of the blocks themselves. It has been found that a block 10 can be constructed using the structure of either FIG. 1 or FIG. 2 (or any other embodiment illustrated herein), depending upon the purpose for which they are needed, with an overall height, width, and length dimension of 8 inches by 8 inches by 16 inches, and a weight of approximately 40 lbs. A block of this weight is readily transportable by individuals and is also of a weight that will allow ease in assembly and stacking of the blocks 10. The block 10 may have other dimensions and weight without departing from the scope of this invention.

With reference to FIGS. 3 and 4, it can be seen that the male portions 18, the slots 20, the top projection 24, the bottom slot 28, and the walls connecting them are all tapered. It has been found that heavy caliber projectiles, such as 50 caliber, have penetration power that requires subtle revision to the blocks 10. While stacking to avoid long, linear seams is useful, other measures are also needed. Tapering the end walls 21 in and toward the slot 20 and the end wall 22, outward away from the male portion 18 creates a non-linear joint that will cause tumbling and consequently capture of projectiles. The vertical side walls 25 of the projection 24 can also be tapered to match a taper of the side walls 29 of the bottom slot 28. In one embodiment the preferred angle of the tapered walls is in the range of approximately zero degrees to approximately 11 degrees, more preferably about 10 degrees. However, when the blocks 10 are used for other alternative uses not requiring projectile protection (e.g., flood wall construction), the tapered interfaces can be omitted.

Figure 5:
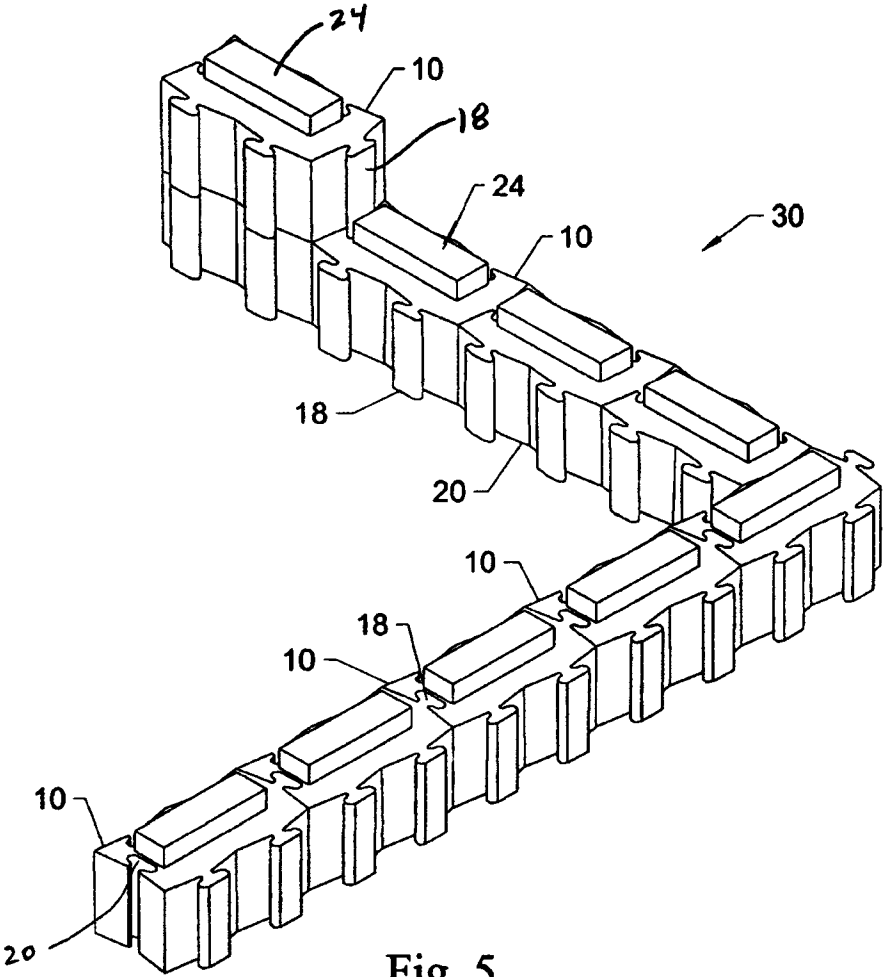
FIG. 5 illustrates the assembly of a plurality of the armored building blocks of the present invention into rows.
Figure 6:
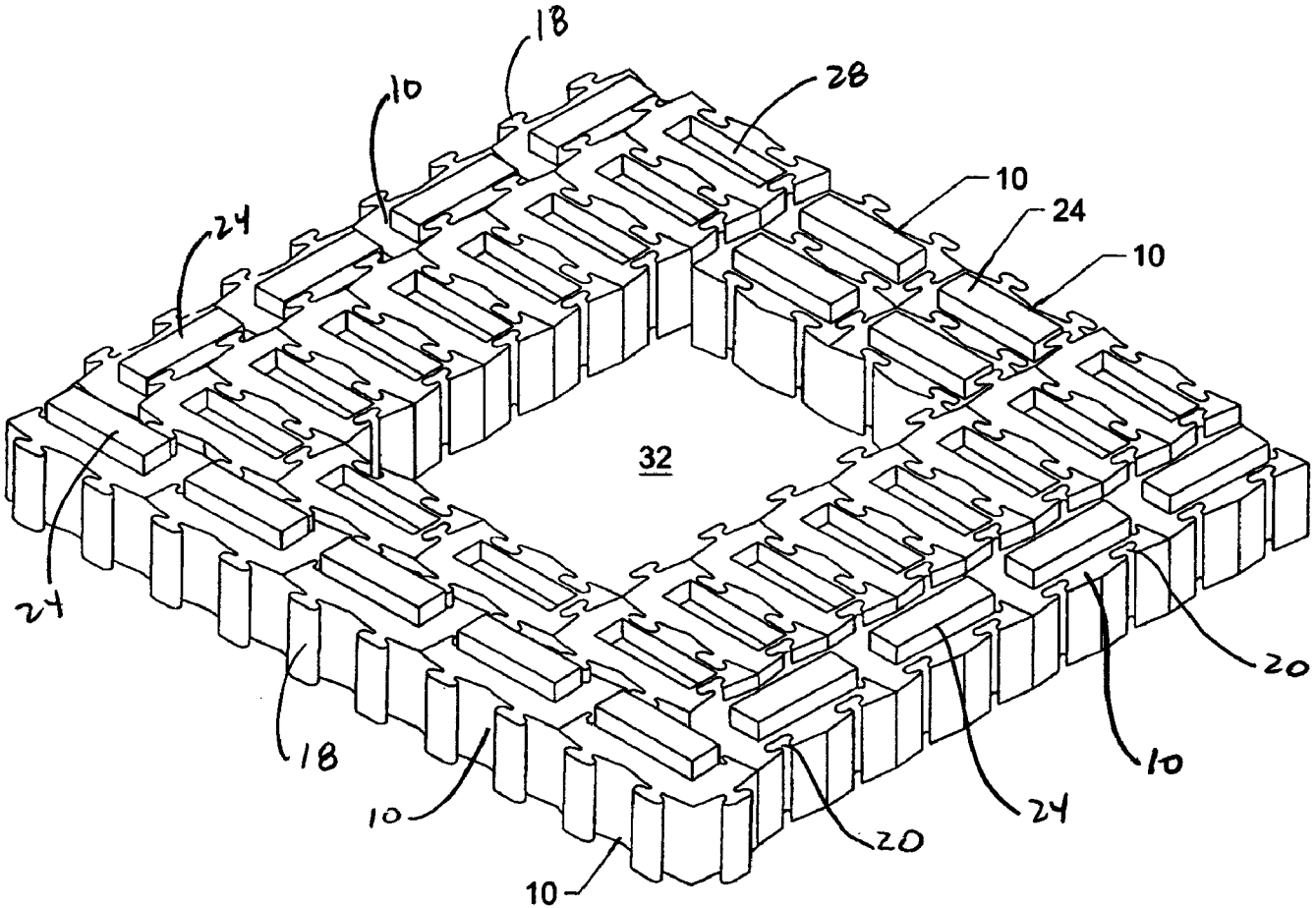
FIG. 6 illustrates the assembly of a plurality of armored building blocks to enclose a space and provide significant armor penetration protection.

FIGS. 5 and 6 illustrate a use of the blocks 10 in a manner to form both a wall and an enclosure. In FIG. 5, a wall 30 is constructed from a plurality of blocks 10, which it can be seen are interlocked using the interlocking male portions 18 and the slot portions 20. In addition, at least one additional block 10 is shown as being stacked with the rectangular projection 24 engaging the slot 28 in the lower surface 26. That interconnection cannot be seen since the blocks 10 are stacked on each other. However, in the wall 30, shown as being partially constructed, the remaining blocks 10 that have not had other blocks stacked on them illustrate the rectangular projection 24. It is understood that the lower surface 26 will include the slot 28.

FIG. 6 illustrates a somewhat more complex structure with a number of blocks 10 having been interconnected to form an enclosed compound 32. Note that in FIG. 6, the blocks 10 have been arranged so that a lateral thickness of more than one block presents itself in all directions. This is done in order to provide additional protection from projectiles that might be aimed at the structure and the enclosed compound 32. FIG. 6 shows only a single vertical layer of blocks 10. However, it will be appreciated that the arrangement of FIG. 6, providing an enclosed compound 32, could use blocks 10 stacked in multiple vertical layers as high as necessary. Once again, this stacking feature can use the rectangular projections 24 and the corresponding slot portion 28. Further, the compound 32 can include one or more walls of interconnected blocks 10 having the same or different number of vertical layers of blocks without departing from this invention. Further, the various structures (e.g., compound 32) disclosed herein may include a separate internal structural member, such as a building wall (not shown) or other structural member, around which the blocks 10 form a protective armor.

When using the blocks 10 of the present invention to build projectile resilient, armored structures, care should be taken to avoid butt joints with long linear seams oriented in the direction of anticipated incoming projectiles. An incoming projectile that is aligned with a butt joint seam in a wall between two blocks 10 will penetrate deeper than a projectile impacting the wall on a non-aligned section. The shape of the blocks 10 allows the flexibility to construct structures that can avoid long, straight surface segments that may form part of a butt seam, thus minimizing the possibility that a projectile will penetrate the armor structure by traveling along a butt seam between two blocks 10.

Figure 7:
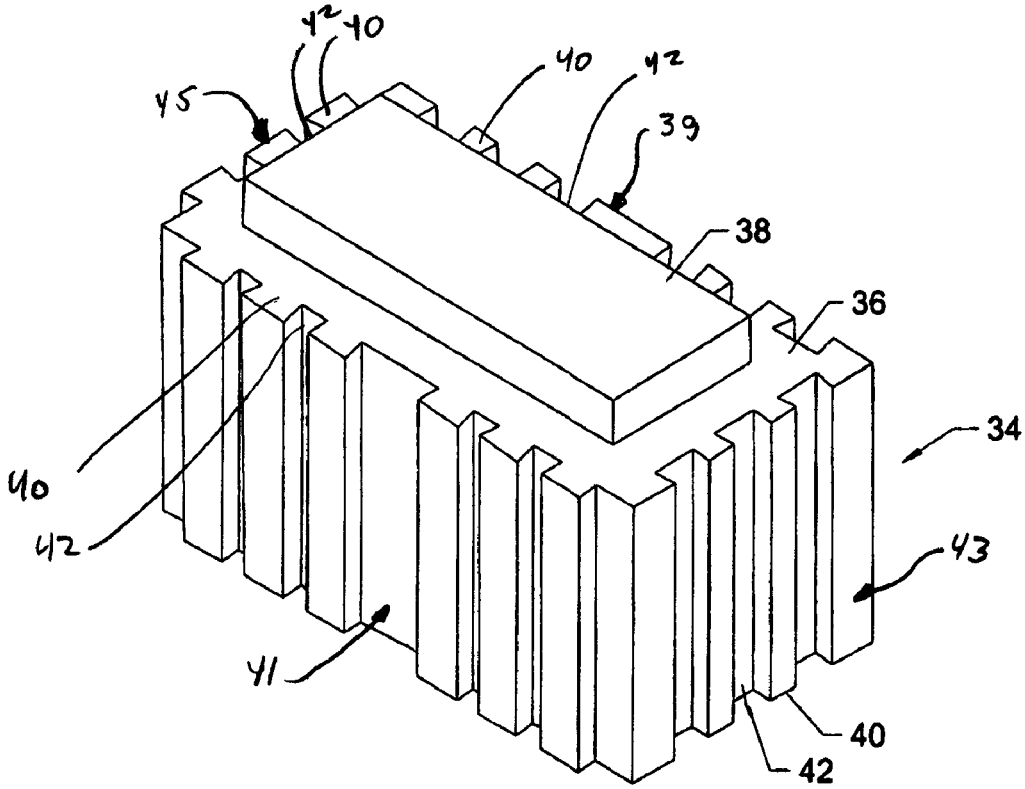
FIG. 7 is an alternative embodiment of the shape of the block of the present invention.
Figure 8:
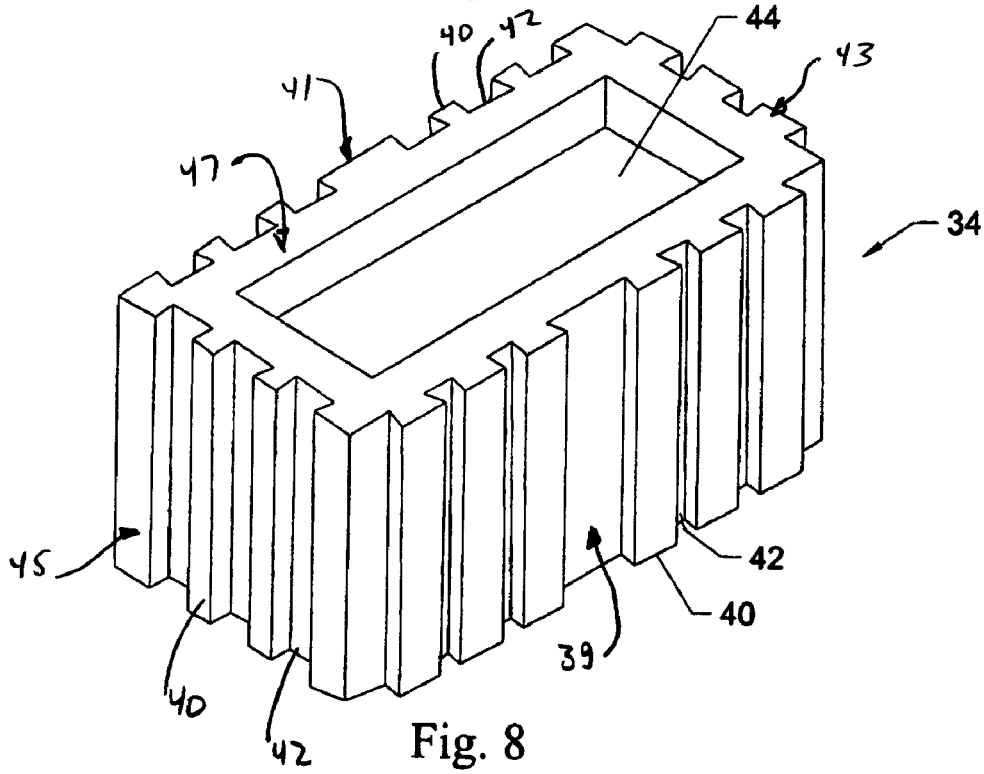
FIG. 8 is a bottom view of the block of FIG. 7.

FIGS. 7 and 8 show an alternative embodiment of a polymeric block 34 used to form various armored structures. FIG. 8 shows a bottom view of the block 34 in FIG. 7. The block 34 in FIGS. 7 and 8 can be constructed in accordance with the general internal structure described with respect to FIGS. 1 and 2. However, the external configuration for the block 34 is somewhat different than that shown with respect to FIGS. 3 and 4. The concept is identical to that previously described, in that the desire is to provide a polymeric block 34 that may be assembled into a variety of armored structure configurations using a single block unit for ease of inventory. In the case of the block 34, the top surface 36 contains a rectangular projection 38. The side surfaces 39, 41 and end surfaces 43, 45 of the block 34 are formed in what might be thought of as a corrugated pattern with alternating lands 40 and valleys 42. The lands 40 and valleys 42 are cut in a manner as to allow their interconnection.

FIG. 8 shows a bottom view of the block 34 and illustrates the slot 44 that cooperates with the projection 38 to allow interlocking of the blocks 34. Thus, the block 34 shown in FIGS. 7 and 8 can be used to build structures such as that previously described with respect to FIGS. 5 and 6 or other suitable structures.

Figure 9:
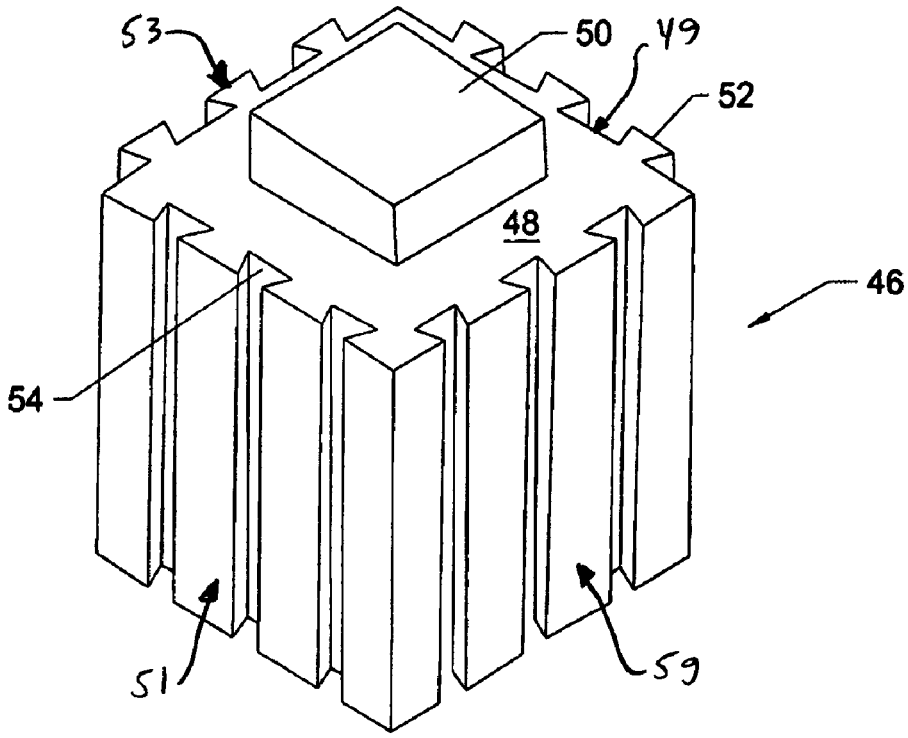
FIG. 9 is an additional embodiment of the shape of the block of the present invention.
Figure 10:
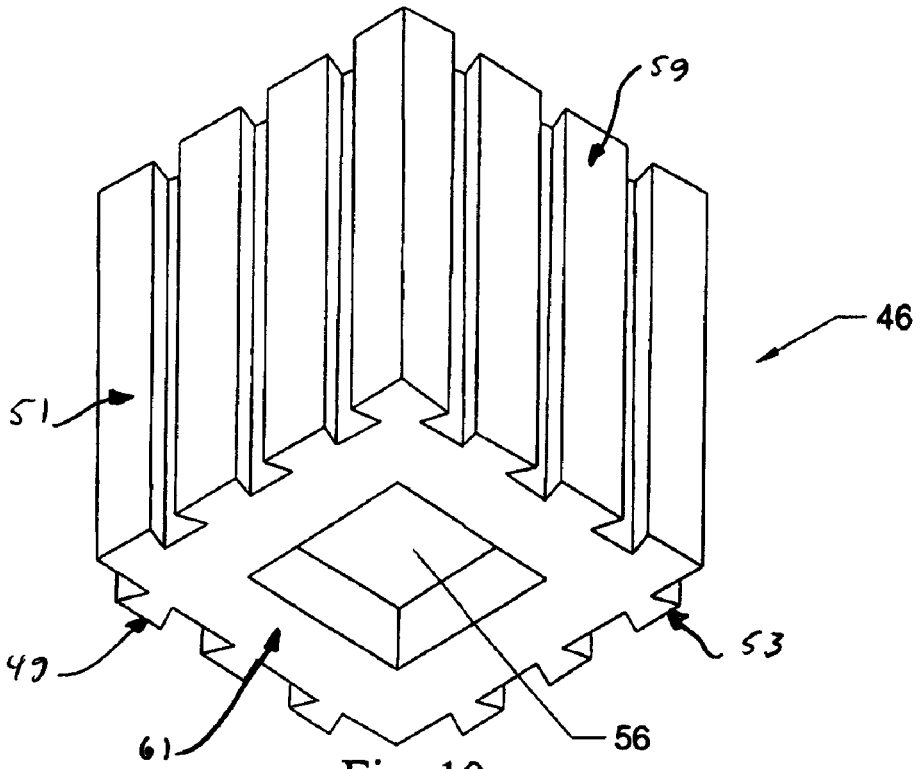
FIG. 10 shows the block of FIG. 9 from below.

FIGS. 9 and 10 illustrate yet another embodiment of a polymeric block 46. The block 46 is of a generally square configuration and has a top surface 48 from which a generally square projection 50 upwardly extends. The polymeric block 46 has a corrugated exterior surfaces 49, 51, 53, 59, somewhat similar to that described with respect to FIGS. 7 and 8, but it can be seen that the end surface of the block 46 includes dovetail projections 52 and corresponding dovetail slots 54. The dovetail projections 52 fit into the dovetail slots 54 to allow interlocking of the blocks 46. The bottom view of the block 46 in FIG. 10 shows a generally square recess portion 56 in the bottom surface 61 of block 46. The square recess portion 56 cooperates with the square projection 50 to allow vertical stacking and interlocking of the blocks 46. Again, the blocks 46 can be used in a manner similar to the blocks in FIGS. 3 and 4, and FIGS. 7 and 8 to build armored structures such as those described with respect to FIGS. 5 and 6 or other suitable structures.

Figure 11:
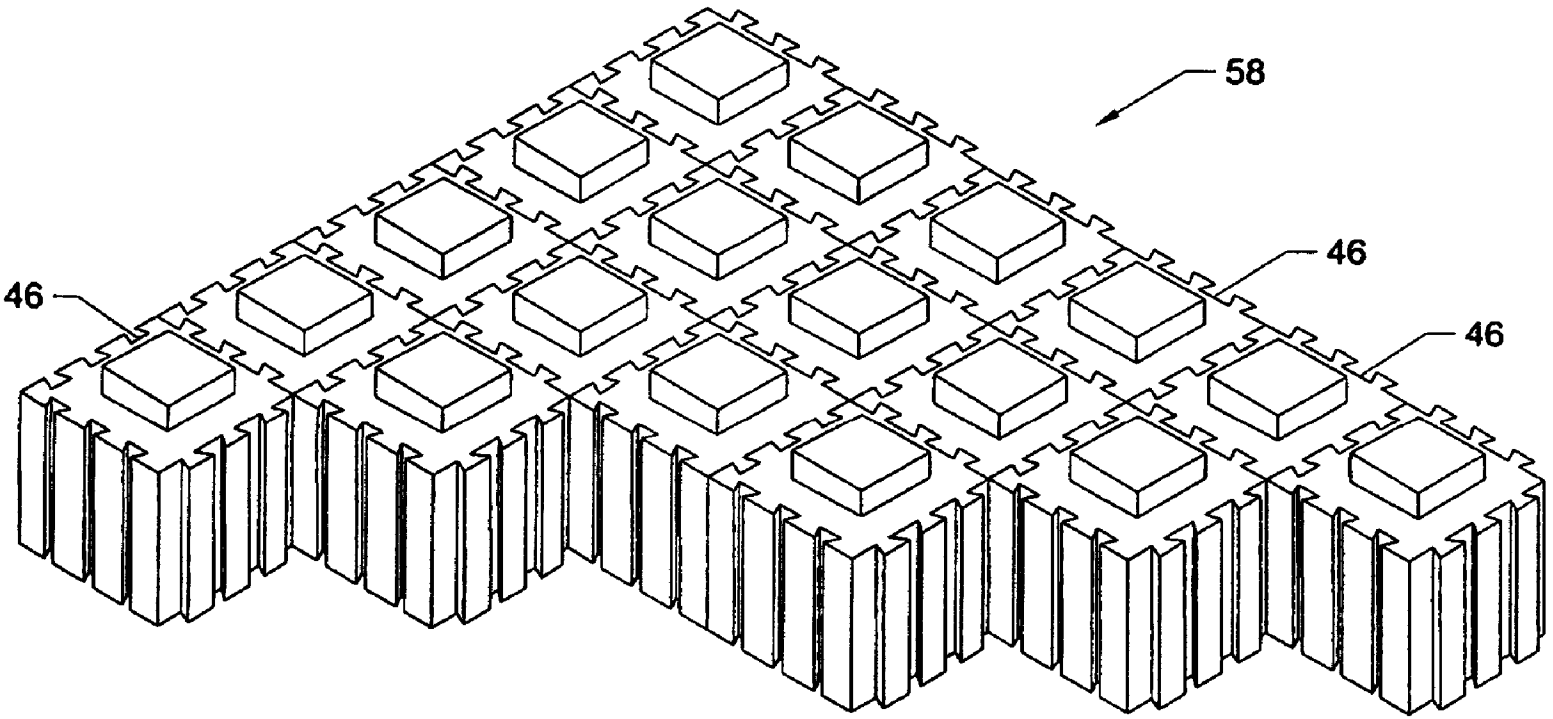
FIG. 11 shows a structure assembled from the blocks shown in FIGS. 9 and 10.

FIG. 11 shows a wall structure 58 made up of a plurality of the polymeric blocks 46, shown in FIG. 9. This illustrates the flexibility of interconnection of the blocks 46 to make armored structures 58 of various configurations. The armored structure 58 may include a separate internal structural member, such as a wall (not shown), or the structures may include single or multiple vertical layers of blocks 46 that act as the wall of the enclosed structure, such as for a temporary compound or base.

It should be understood that the lands 40, valleys 42, projection 38, slot 44, dovetail projection 52, dovetail slot 54, projection 50, and recess 46 may all be tapered in the manner described with respect to FIGS. 3 and 4. That is, the interlocking portions of the blocks 34 and 46 may be angled to avoid linear seams, for reasons previously explained.

Figure 12:
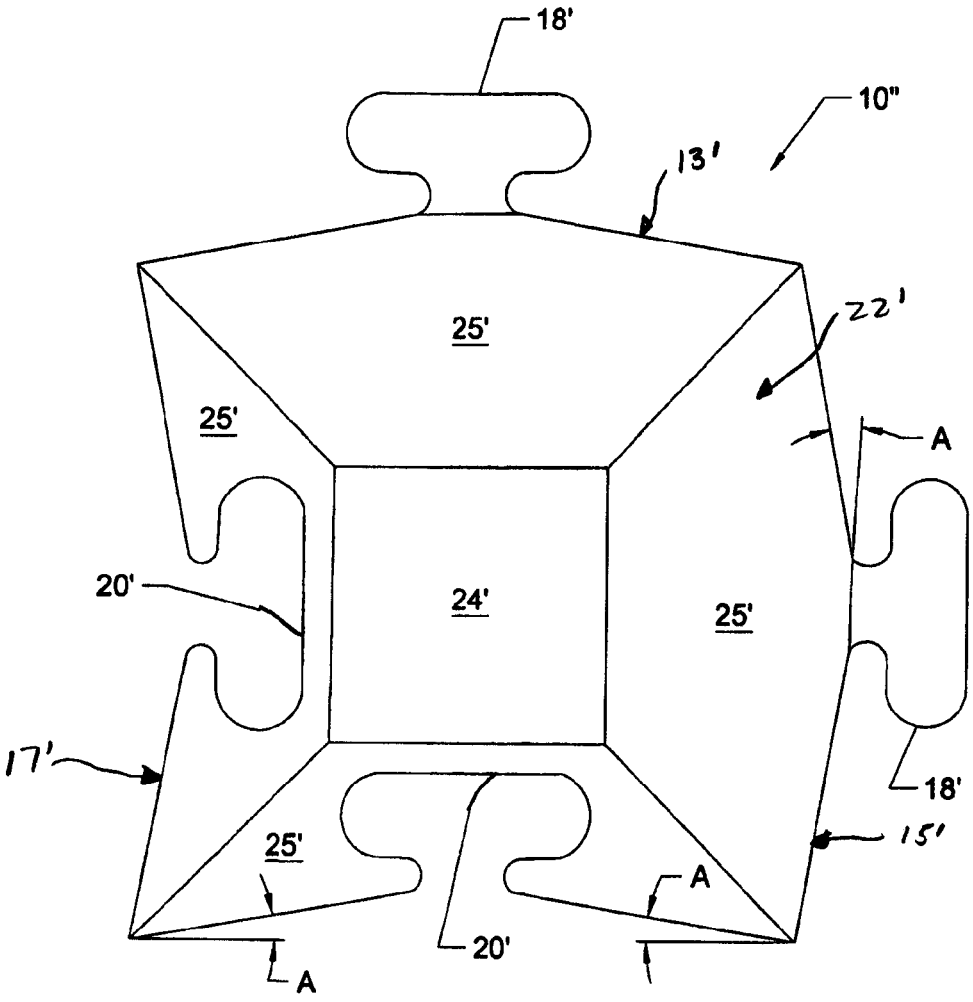
FIG. 12 is a top view of the block of the present invention.
Figure 13:
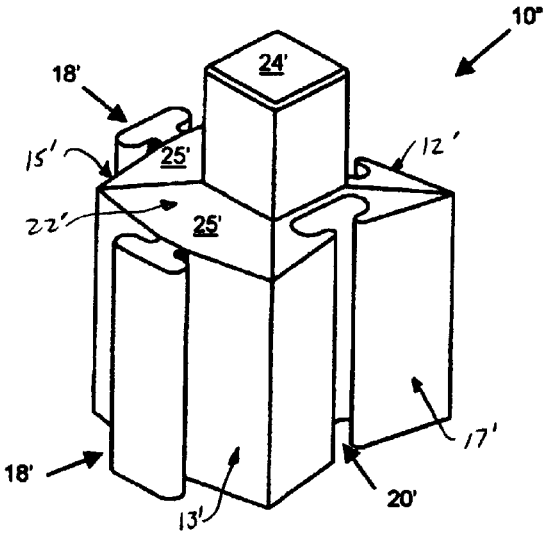
FIG. 13 is a top oblique view of the block shown in FIG. 12.

FIGS. 12 and 13 further illustrate the tapering of the sidewalls of the block of the present invention as discussed with respect to FIGS. 3 and 4. In FIGS. 12 and 13, a block 10" has single male portions 18' on an end surface 15' and a single male portion on a side surface 13'. The block 10" has a single slot 20' in end surface 17' and a single slot in side surface 12'.

In the illustrated embodiment, the block 10" is generally square, as opposed to the rectangular shape shown in FIGS. 3 and 4. The block 10" includes a top projection 24' in top surface 22' and also has a corresponding bottom slot (not shown). The end surface 17' and side surface 12' are tapered in toward the slots 20' at an angle A. The end surface 15' and side surface 13' taper away from the male portions 18' at the same angle A. The top surface 22' includes upwardly sloping side walls 25' that slope upwardly from the top edges of respective side surfaces 12', 13' and end surfaces 15', 17' to the base of projection 24'.

Figure 14:
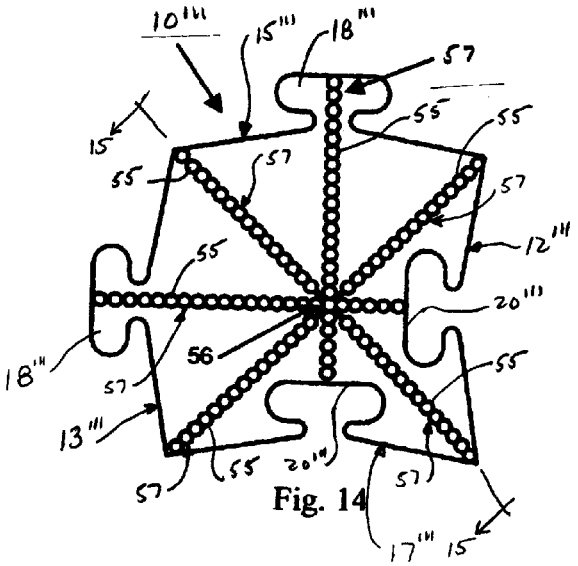
FIG. 14 is a top view of a horizontal cross-section of approximately the center of the block shown in FIGS. 12 and 13.
Figure 15:
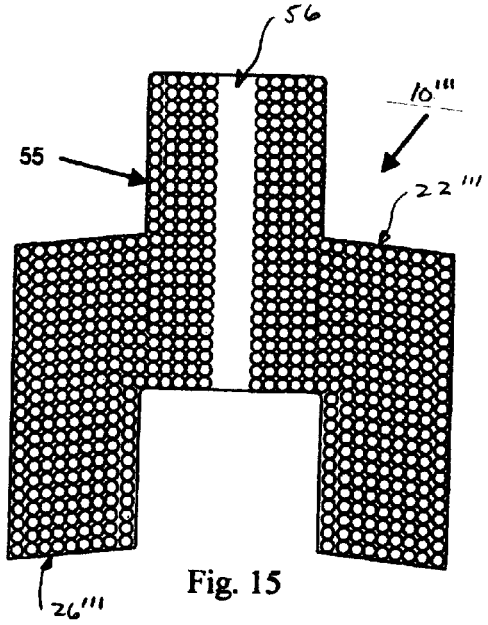
FIG. 15 is a side view of a vertical cross-section of approximately the center of the block shown in FIGS. 12, 13 and 14.

FIGS. 14 and 15 illustrate a block 10'" in an alternative embodiment of the invention having an arrangement of hardened objects 55 (broadly "projectile deflecting objects") interspersed within the interior of the block. The block 10'" is substantially similar to the block 10" of the previous embodiment, but the block with hardened objects 55 may be otherwise shaped and configured without departing from the invention. In the illustrated embodiment, the hardened objects 55 are spherical balls made of a steel alloy, although other suitable materials may be used. FIGS. 14 and 15 show a plurality of spherical objects 55 arranged into a plurality of column and row matrices. To facilitate construction of the block 10'" and the interspersion of the plurality of hardened objects 55 into the interior of the block, a plurality of the individual hardened objects of the matrix may be attached to each other by welding or other suitable means so as to form a substantially planar, unitary, matrix structure, generally indicated at 57. In the illustrated embodiment each matrix structure 57 includes a single, radial row of hardened objects arranged in multiple vertical columns, each vertical column generally extending from the bottom surface 26'" to the top surface 22'" of the block 10'". As further illustrated in FIG. 14, a plurality of such two dimensional matrices 57 of the hardened objects 55 may be oriented extending radially outward from a central location 56 within the interior of the block 10'" and attached at such central location by welding or other similar means. In the illustrated embodiment, the matrix structures 57 are arranged in a "star" configuration analogous to spokes of a wheel extending radially outward from the central location 56. Such a "star" or "spoked-wheel" configuration forms the plurality of substantially planar, unitary matrices into a free standing structure that may be placed inside a mold for forming the block 10". The polymeric material of the block 10" may then be poured into the mold surrounding the free standing matrices 57 using conventional pour molding, compression molding, injection molding, and other similar methods known in the art.

While objects 55 are illustrated in FIGS. 14 and 15 as being spherical in shape, elliptical, polyhedral, or other geometric or even irregular shapes and sizes may be used without departing from the spirit and scope of the invention. Furthermore, while FIGS. 14 and 15 illustrate hardened objects that have been formed into matrices of rows and columns, other spatial configurations and arrangements of the hardened objects may be employed without departing from the spirit and scope of the invention. Further, the plurality of objects 55 may include objects of different size and shape without departing from the scope of this invention. Moreover, the hardened objects 55 in FIGS. 14 and 15 are illustrated as touching each other and are previously described as potentially welded or similarly attached to each other for ease of assembly and construction of the completed armor blocks. However, it is not crucial to the performance of the invention in stopping incoming projectiles that the individual objects be in either physical contact with each other, attached to each other, or that they be organized and oriented into any particular pattern. Nevertheless, it is preferred that a sufficient number of hardened objects 55 be interspersed within the interior of the block 10" and are spaced at intervals from each other in such a manner that any incoming projectile will encounter at least one hardened object while penetrating the block 10".

One of skill in the art will appreciate that the size and mass of the individual hardened objects 55 may vary depending on the particular type of projectile that my be encountered. Generally, the size and mass of the individual hardened objects 55 may be decreased as the overall size, mass, and velocity of the incoming projectile decreases. By way of example, the hardened objects 55 may be spherical steel balls with a diameter of approximately ½ inch and may be formed into a welded, unitary matrix structure with parallel rows and columns which has proven effective at stopping .50 cal BMG incoming rounds. In other embodiments, the spherical steel balls 55 may be otherwise sized (e.g., having a diameter of more or less than approximately ½ inch) and may be spaced apart a small distance (e.g., at least approximately 0.002 inches). Furthermore, the objects 55 may have a minimum Rockwell hardness of at least about 20 HRC, more preferably approximately 25 HRC to approximately 30 HRC.

Figure 16:
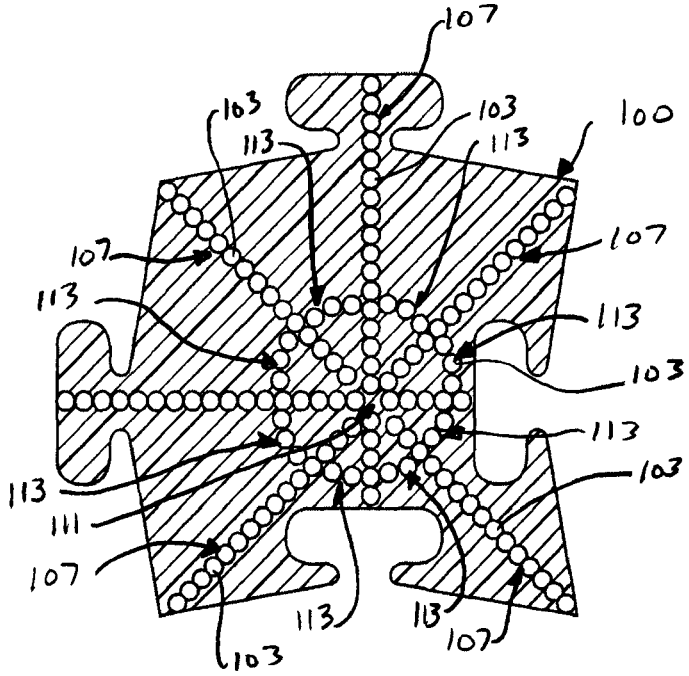
FIG. 16 is cross-section similar to FIG. 14 but showing an alternative embodiment of a block of the present invention.
Figure 17:
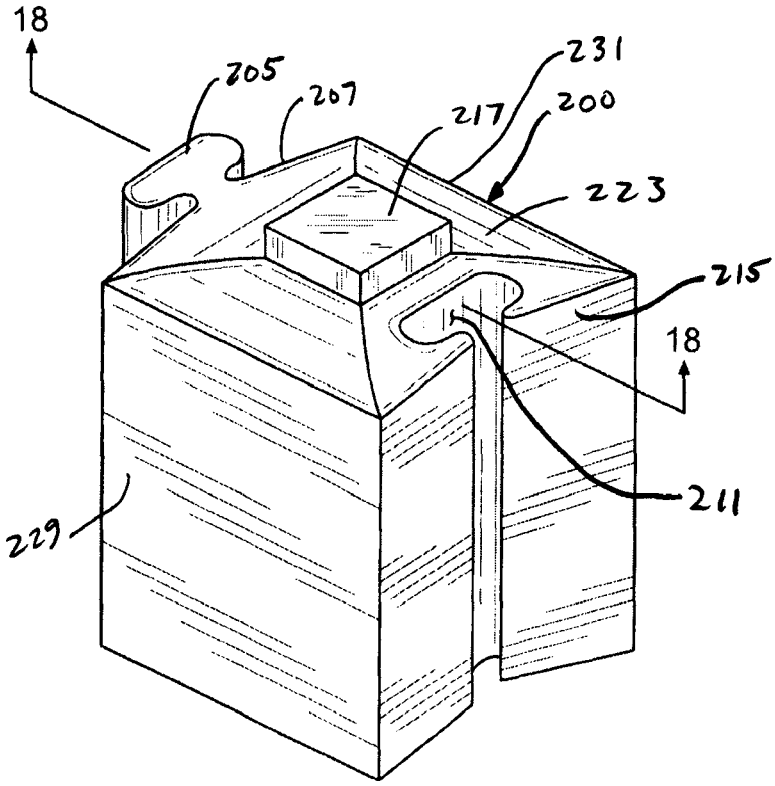
FIG. 17 is perspective of a block of another alternative embodiment of the present invention.

FIG. 16 illustrates an alternative embodiment of a block 100, similar to the block 10'" of the previous embodiment. In the embodiment of FIG. 16, the block 100 has a plurality of hardened objects 103 (e.g., spherical balls) arranged in a plurality of two-dimensional matrices 107 oriented in a similar "star" arrangement as the objects 55 of the block 10'". The "star" arrangement of the objects 103 includes eight radial spokes 107, each comprising vertical columns of hardened objects 103, arranged in a general linear arrangement radiating from a central location 111. In the embodiment of FIG. 16, the block 100 includes respective arcuate walls 113 of hardened objects 103 positioned between respective spokes 107. Each arcuate wall 113 includes a plurality of vertical columns of hardened objects 103 arranged in a curve so that all the arcuate walls combine to form a generally circular central barrier or wall extending the height of the block. Additional arcuate walls 113 of hardened objects 103 may be provided at alternative radial locations from the central location 111 of the spokes 107 to provide one or more additional barriers to prevent the passage of a projectile through the central location. Further, the arcuate walls 113 and the radial spokes 107 of this embodiment extend from the bottom 117 to the top 121 of the block 100 to provide a complete barrier to projectile penetration through the block regardless of the vertical location of the point of entry of the projectile and the direction of the trajectory of the projectile. The arcuate walls 113 provide a barrier that impedes the travel of projectiles that are repeatedly fired at the same location of the block 100. These projectiles may be more likely to penetrate the block material (e.g., polymer) that is weakened at the point of repetitive entry by the projectile. The arcuate walls 113 (and spokes 107) provide supplemental protection to the projectile-resistant block material to prevent passage of a projectile through the block 100.

The arcuate walls 113 of hardened objects 103 may be otherwise shaped and arranged to provide additional resistance to projectile penetration without departing from the scope of this invention. For example, the arcuate walls 113 and/or the spokes 107 may be a single hardened object or may include objects that are shaped other than spherical. Also, multiple arcuate walls 113 could be provided or additional barriers of hardened objects 103 could be included in the block 100 having shapes other than arcuate (e.g., straight, irregular, etc.).

FIGS. 17-20 show a block 200 of an alternative embodiment of the invention. The block 200 is configured for interlocking engagement with other similarly shaped blocks to build a structure or armor in a similar manner as the previous embodiments. The block 200 includes an interlocking male connector 205 on one end surface 207 of the block and a female connector 211 on a second end surface 215 of the block for receiving a male connector (not shown) of a second or subsequent block (not shown). The block 200 has a top projection 217 on a top surface 223 of the block and a recess 219 (FIG. 19) in the bottom surface 225 of the block for receiving a top projection (not shown) of a second or subsequent block (not shown). The block 200 has a pair of generally planar spaced apart side surfaces 229, 231 that are generally free from interlocking projections or mating recesses. Alternatively, the male connector 205 and the female connector 211 may be located on respective side surfaces 229, 231 of the block 200. The planar surfaces 229, 231 could be otherwise shaped (e.g., tapered) without departing from this invention. In this embodiment, the block 200 is a two-dimensional interlocking block in that the opposed end surfaces 207, 215 have corresponding mating projections and mating recesses (e.g., male connector 205 and female connector 211) and the top and bottom surfaces 223, 225 have corresponding mating projections and mating recesses (e.g., top projection 217 and recess 219).

Figure 19:
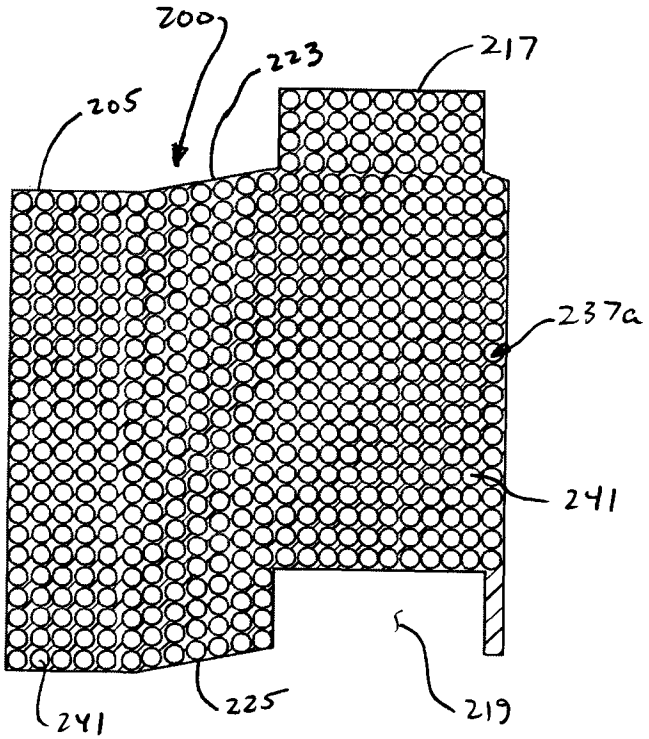
FIG. 19 is a vertical cross-section taken along the plane including line 19-19 of FIG. 18.
Figure 18:
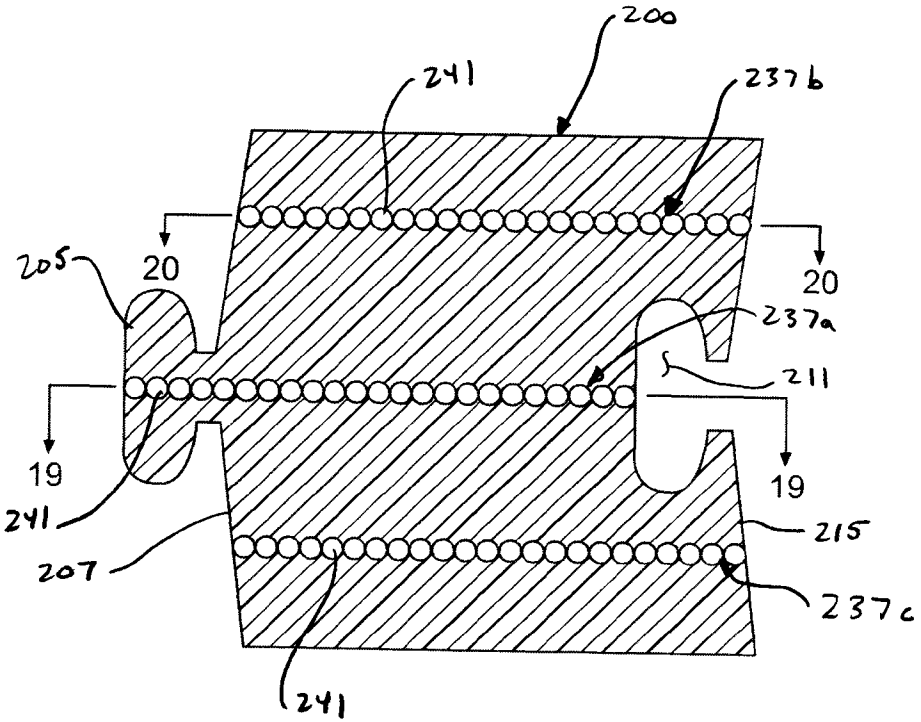
FIG. 18 is a horizontal cross-section taken along the plane including line 18-18 of FIG. 17.
Figure 20:
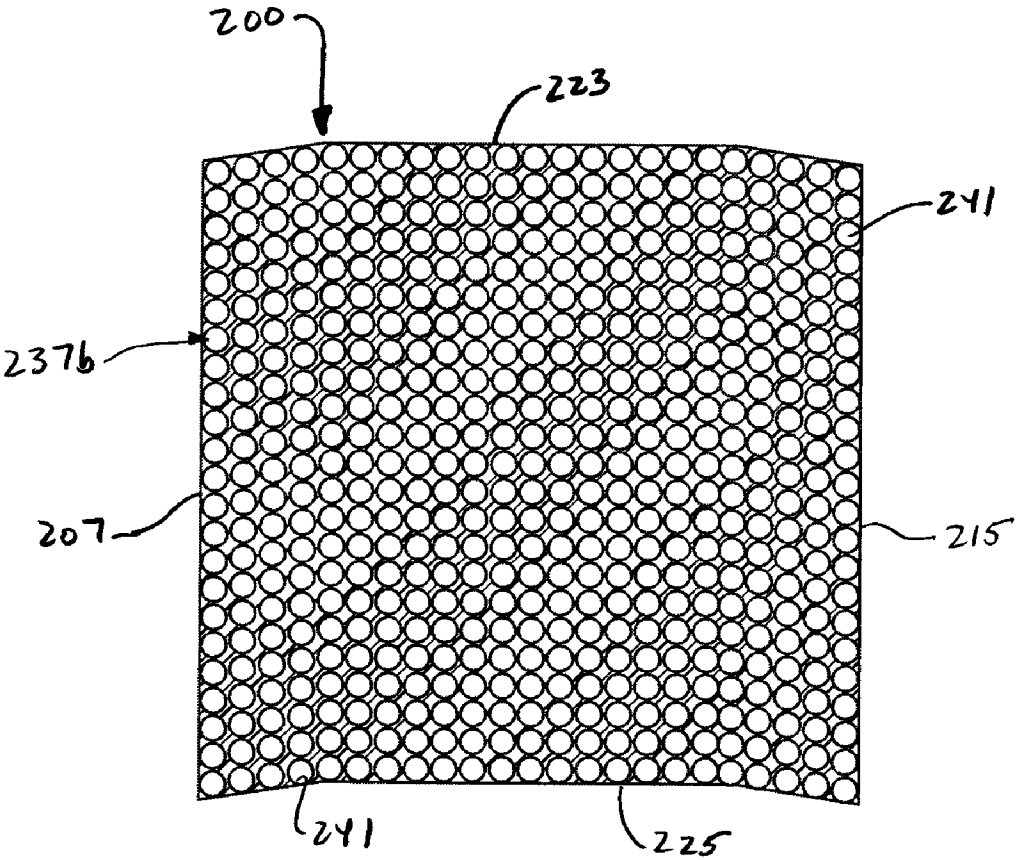
FIG. 20 is a vertical cross-section taken along the plane including line 20-20 of FIG. 18.

As shown in FIG. 18, the block 200 has a plurality of two-dimensional matrices 237*a*, 237*b*, 237*c* of hardened objects 241. In the illustrated embodiment, the matrices 237*a*, 237*b*, 237*c* are arranged in a parallel arrangement. As shown in FIGS. 18 and 19, one of the matrices 237*a* passes generally through the middle of the block 200 so that the hardened objects 241 extend from the inner surface of the female connector 211 into the male connector 205. As shown in FIGS. 18 and 20, the matrices 237*b*, 237*c* are spaced apart from the middle matrix 237*a* such that the hardened objects 241 of the two outward matrices respectively extend between the tapered end walls 207, 215. It is understood that the hardened objects 241 can be omitted from the block 200, or that the hardened objects could be otherwise arranged, including in nonparallel matrices or other configurations, without departing from the scope of the invention.

The foregoing description illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the invention covers various modifications, combinations, additions, and alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A building block for constructing a projectile absorbing armor, the building block comprising:

a top surface;

a bottom surface;

a first side surface and a second side surface;

a first end surface and a second end surface, said top, bottom, side, and end surfaces cooperating to form an interior;

a projection on said top surface;

a recess in said bottom surface, said projection and said recess being sized for interlocking engagement;

at least one interlocking male connector on at least one of said first side surface, said second side surface, said first end surface, and said second end surface; and at least one female connector on at least one of said first side surface, said second side surface, said first end surface, and said second end surface, said interlocking male connector and said female connector being sized for interlocking engagement, wherein said interior comprises a plurality of projectile deflecting objects to inhibit the travel of a projectile through the block, wherein said projectile deflecting objects are arranged in at least two radial spokes radiating from a central location in the interior, and wherein said projectile deflecting objects are arranged in at least one arcuate wall extending between said at least two radial spokes.

2. The building block of claim 1 wherein said first and second side surfaces are generally opposed surfaces and said first and second end surfaces are generally opposed surfaces.

3. The building block of claim 2 wherein said at least one male connector comprises one male connector on said first side surface and said at least one female connector comprises one female connector on said second site surface.

4. The building block of claim 1 wherein said at least one interlocking male connector comprises a first and a second interlocking male connector, said first interlocking male connector being on one of said first and second side surfaces and said second interlocking male connector being on one of said first and second end surfaces.

5. The building block of claim 4 wherein said at least one female connector comprises a first and a second female connector, said first female connector being on one of said first and second side surfaces and said second female connector being on one of said first and second end surfaces.

6. The building block of claim 1 wherein said at least two spokes and said at least one arcuate wall extend vertically from said bottom surface to said top surface.

7. The building block of claim 6 wherein said at least two spokes and said at least one arcuate wall respectively include multiple columns of hardened objects.

8. The building block of claim 1 wherein said projectile deflecting objects are arranged in a plurality of parallel rows extending between said first end surface and said second end surface.

9. The building block of claim 8 wherein said plurality of parallel rows each include multiple columns of hardened objects extending vertically from said bottom surface to said top surface.

10. The building block of claim 1 wherein said projectile deflecting objects comprise a material having a hardness of at least 20 HRC.

11. The building block of claim 10 wherein said projectile deflecting objects comprise hardened steel balls.

12. The building block of claim 1 wherein said interior comprises a projectile resistant material.

13. The building block of claim 10 wherein said projectile resistant material comprises at least two layers, said at least two layers comprising an outward facing layer of a first density and inward layer of a second density, said second density being greater than said first density.

* * * * *